US005211224A

United States Patent [19]

Bouldin

[11] Patent Number: 5,211,224

[45] Date of Patent: May 18, 1993

[54] ANNULAR SHAPED POWER CHARGE FOR SUBSURFACE WELL DEVICES

[75] Inventor: Brett W. Bouldin, Friendswood, Tex.

[73] Assignee: Baker Hughes Incorporated, Houston, Tex.

[21] Appl. No.: 857,755

[22] Filed: Mar. 26, 1992

[51] Int. Cl.[5] ..... E21B 23/04

[52] U.S. Cl. ..... 166/63; 166/65.1; 175/4.52; 102/284

[58] Field of Search ..... 166/55, 63, 65.1; 175/4.52; 102/531, 284

[56] References Cited

U.S. PATENT DOCUMENTS

| | | | |
|---|---|---|---|
| 3,213,793 | 10/1965 | Dratz | 102/284 |
| 3,233,674 | 2/1966 | Leutwyler | 166/63 |
| 3,496,870 | 2/1970 | Fulmer . | |
| 3,737,348 | 6/1973 | Schultz et al. | 102/284 X |
| 4,275,657 | 6/1981 | Dallet | 102/531 |

*Primary Examiner*—Terry Lee Melius
*Attorney, Agent, or Firm*—Charles D. Gunter, Jr.

[57] ABSTRACT

An annular shaped gas generating power charge is shown of the type which can be used in a downhole tool in a well. The charge is provided in the form of a longitudinal strip of solid propellant having a length and a width, a leading end which defines a burn area, a trailing end and opposing side edges. The strip is helically wrapped in at least one spiral turn about a central axis so that the opposing edges of the strip abut one another to form an annular shape. The annular shape provides a controlled gas generation rate and can be installed in the setting chamber of a downhole tool to provide a controlled setting action of the elastomeric components of the downhole tool.

7 Claims, 4 Drawing Sheets

ANNULAR SHAPED POWER CHARGE FOR SUBSURFACE WELL DEVICES

BACKGROUND OF THE INVENTION

1. Field of the Invention

The present invention relates to subsurface well devices and methods and particularly to gas generating power charges of the solid propellant type used to actuate the operative components of such devices.

2. Description of the Prior Art

A variety of subsurface well devices are known in the art which require actuation of operative components once the device is positioned at a given depth in the well bore. Such subterranean well devices include packers, bridge plugs, drill stem test tools, tubing hangers, safety and other valves, test trees, and the like. These subsurface well devices have been operated in the prior art by a wide variety of mechanisms. One of the more common methods is by manipulating the tubing string, e.g., pushing and/or pulling, tubular rotation, and the like. Other actuation methods include the use of hydraulic/-hydrostatic pressure, as where an actuating fluid is pumped through the bore of the production tubing or work string to the downhole device to actuate the device.

Both of the previously mentioned actuating methods suffer from certain disadvantages. Manipulation of the tubing string can be difficult to accomplish at extreme depths or in the case of deviated wells. The use of through the tubing fluid pressure to actuate down hole devices requires the presence of ports or openings in the wall of the tubing string. Such openings provided in the wall of the production tubing or work string must be effectively sealed against leakage of any fluids subsequently carried in the tubing, such as the produced well fluids. Since the seals that are employed in and between operating components of well tools, such as pistons and housings, are subject to deterioration and leakage, it is difficult to insure sealing integrity. Also the use of hydrostatic pressure is generally not feasible at shallower well bore depths where the available pressure is too low.

One way to eliminate the need for manipulation of the tubing string during actuation procedures is to provide a downhole energy source, such as a gas generating solid propellant or power charge, which can be ignited to provide kinetic energy by the provision of a suitable triggering signal. By mounting the power charge and triggering device in an annular space created on the exterior of the tubing string, e.g. between the exterior of the tubing string and a surrounding cylindrical member, the need for ports or openings in the wall of the tubing string can be eliminated.

The utilization of a downhole energy source which can be transformed into kinetic energy by the provision of a triggering signal to operate a well tool is shown, e.g., in U.S. Pat. No. 3,233,674. The downhole source of energy is an explosive charge which is discharged and the resulting gas is applied to a piston which functions to set a hanger in a well casing. The triggering signals for energizing the downhole circuitry for effecting the discharge of the explosive charge are produced by a pair of sonic frequency generators which are located at the surface and which are transmitted downhole through well fluids or a tubing string.

In spite of these advances, the provision of an annular shaped power charge in a subsurface well device creates special requirements which are not met by presently available power charges. For instance, in the case of a well packer, an elastomeric packing element is mounted in surrounding relationship to the production tubing or work string and is actuated by the downhole apparatus to sealingly engage the surrounding well bore or casing. The speed of burn or gas generation rate of the gas generating charge should be slow enough to allow the elastomeric components, such as the packing elements, sufficient time to compress and assume a packed-off geometry within the well bore. The use of a relatively slow burning solid propellant is therefore preferred since a sudden explosion, accompanied by a sudden release of energy could damage the parts of the apparatus, or provide insufficient stored sealing stress to seal the packing elements.

A need exists for a annular shaped gas generating charge which is particularly adapted for slow actuation of a variety of downhole tools incorporating elastomeric components.

A need exists for such a gas generating, solid propellant charge which has a characteristic speed or burn rate slow enough to allow elastomeric components, such as packing elements, sufficient time to compress and assume a desired geometry without damage to the components.

SUMMARY OF THE INVENTION

The annular shaped power charge of the invention comprises a longitudinal strip of solid propellant having a length and a cross-sectional thickness, a leading end which defines a burn area, a trailing end and external sidewalls. The strip is helically wrapped in at least one spiral turn about a central axis, whereby the external sidewalls of the strip abut one another to form a cylindrical shape. Preferably, the annular shaped gas generating power charge of the invention is polygonal in cross-section and comprises a longitudinal strip of solid propellant having a length and a width, a leading end which defines a burn area, a trailing end and opposing non-combustible side edges. The strip is helically wrapped in at least one spiral turn about a central axis, whereby opposing edges of the strip abut one another to form a cylindrical shape.

The annular shaped, solid propellant power charge of the invention can be incorporated into a downhole tool of the type used in a subterranean well having a tubular conduit of a given length extending downwardly from the well surface into contact with well fluids, at least a portion of the length of the tubular conduit being surrounded by an outer tubular member to thereby create an annular space for containing the power charge. The annular space can also contain a triggering mechanism for igniting the gas generating power charge. Setting means are provided responsive to ignition of the power charge for moving the downhole tool from a running-in position to a set position. The preferred setting means includes a packing element surrounding a portion of the tubular conduit for forming a seal with the surrounding well bore and a piston element. The piston element is slidably and sealably mounted in an annular chamber on the exterior of the tubular conduit and is operatively connected to the packing element for setting the packing element by axial movement of the piston element. Actuation of the power charge moves the piston element axially to set the packer.

Additional objects, features and advantages will be apparent in the written description which follows.

BRIEF DESCRIPTION OF THE DRAWINGS

in FIG. 4;

DETAILED DESCRIPTION OF THE INVENTION

Figure 13:
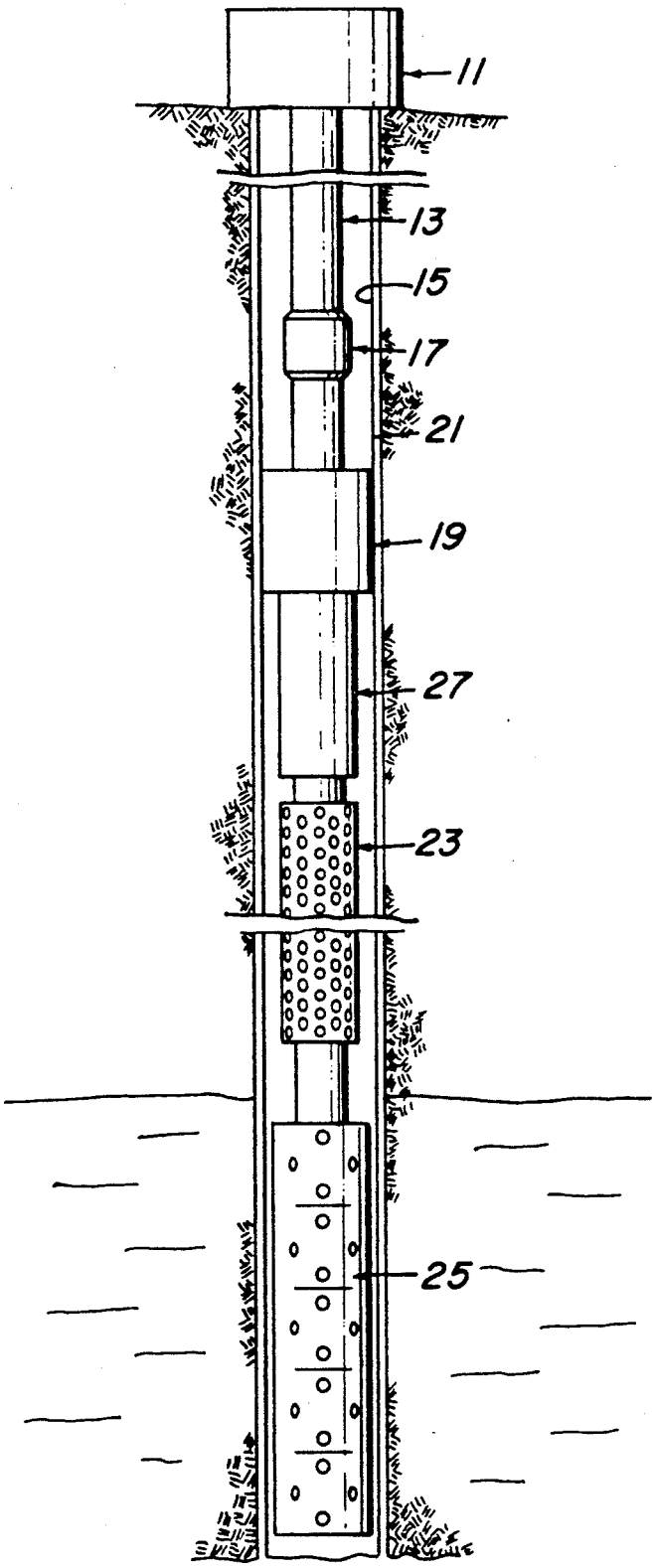
FIG. 13 is a schematic, vertical sectional view of a well showing a tubing string incorporating a packer which has been set using the power charge of the invention.

Turning first to FIG. 13, there is shown schematically a well head 11 securing a tubular production conduit 13 within a subterranean well bore 15. The production conduit 13 may be production tubing, or a tubular work string, conventional in nature and well known to those skilled in the art. The production conduit 13 in this case carries a safety valve 17 which may be a ball, flapper, or other valve construction known to those skilled in the art. A packer 19 is schematically illustrated located on the production conduit 13 below the safety valve 17 with the tubular conduit 13 extending downwardly within the well bore 15 and within a well casing 21.

As is commonly found in the art, a well production screen 23 is shown located on the tubular conduit 13 above a perforating gun 25. The screen 23 is utilized for introduction of production fluids from a production zone of the well into the annular area between the casing 21 and the production conduit 13 and into the interior of the conduit 13 to the top of the well head 11. As will be described more fully, an actuating section 27 is provided for actuating the well packer 19 to pack-off the well bore by sealingly engaging the casing 21.

Figure 1:
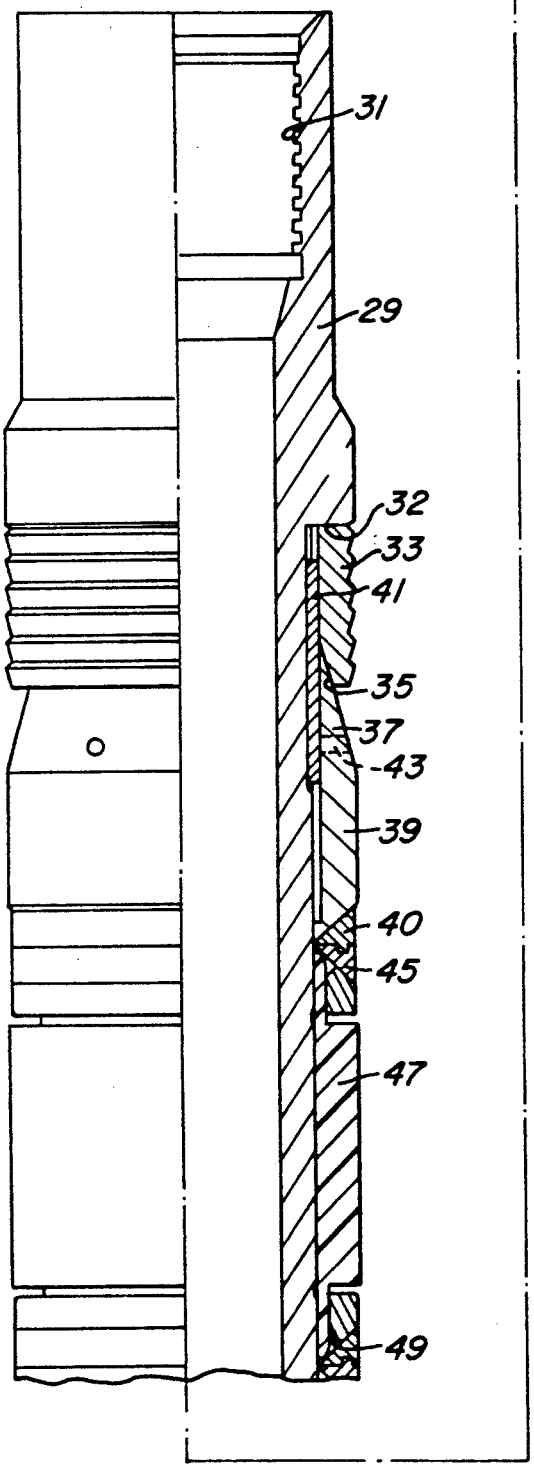
FIG. 1 is a vertical, sectional view of an unset well packer utilizing the gas generating power charge of the invention and showing the elastomeric packing element.
Figure 2:
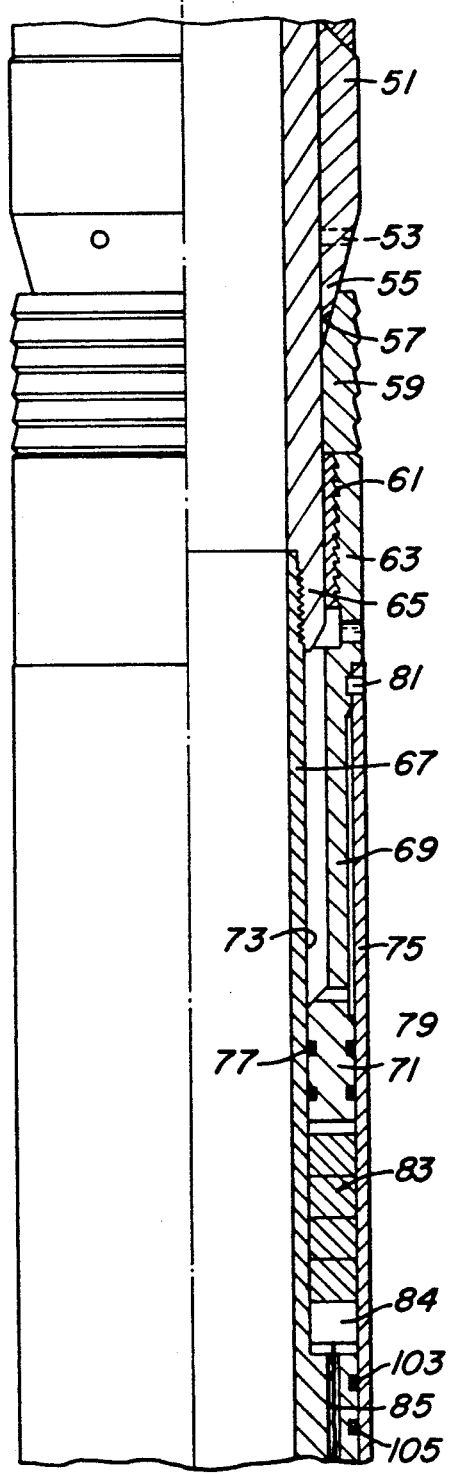
FIG. 2 is a downward continuation of the sectional view of FIG. 1 showing the annular chamber which receives the gas generating power charge of the invention.
Figure 3:
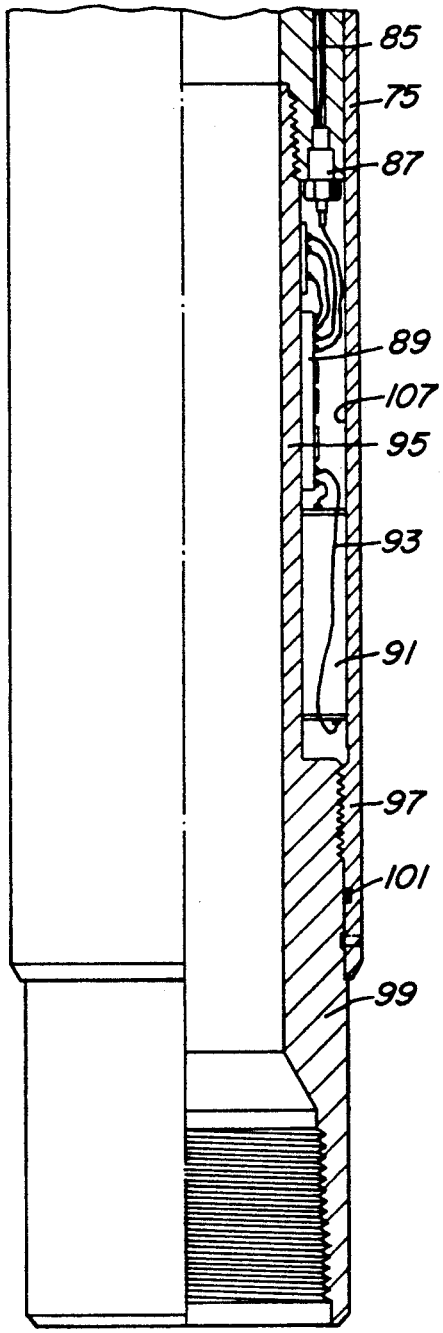
FIG. 3 is a downward continuation of FIG. 2 showing the triggering mechanism used to ignite the power charge of the invention.

FIGS. 1-3 show the packer and actuating section of the apparatus in greater detail. The production conduit 13 extends to a length of tubular conduit 29 having threads 31 at the upper most end thereof for engaging mating threads in the lower most section of the production conduit. A shoulder region 32 of the conduit 29 is used to retain an upper slip member 23 having gripping teeth on the exterior thereof which are used for embedding and anchoring engagement of the packer 19 relative to the well casing 21 when moved from the running-in position shown in FIG. 1 to a set position.

Upper slip member 33 has a lower beveled ramp surface 35 which engages the leading end 37 of an upper cone 39, the cone shown in contact with an anti-rotation key 41 with the upper cone 39 being initially secured in the running-in position by means of shear pins 43. As a result, the upper slip member 33 remains in a retracted position relative to the cone 39 prior to setting actuation.

Below the cone 39 is a an upper, non-extrusion seal member 30, a conventional elastomeric seal element 47 and a lower, non-extrusion seal member 49, all of which will be familiar to those skilled in the art. The lower, non-extrusion seal member 49 is carried around its lower most end on the upper most beveled face of a lower cone element 51 which is shear pinned at pin 53 to the tubular conduit 29.

The lower cone element 51 has a lower ramp 55 which engages a mating ramp surface 57 of a lower slip member 59. The lower slip member 59 has gripping teeth similar in design to the teeth of the upper slip member 33 for anchoring the device relative to the well casing 21 when the tool is in the set position.

Below the lower slip member 59 is a body lock ring 61 which is housed between the exterior of the tubular conduit 29 and the interior of an outer ring element 63 having ratchet threads thereon. As will be familiar to those skilled in the art, the body lock ring 61 and ratchet threads are used to lock the setting energy resulting from the setting actuation of the packer 19 into the upper and lower slip members 33, 59 and thereby insure sealing integrity of the seal element 47 relative to the well casing 21. The ratchet teeth of the body lock ring 61 are, in this case, one-way acting.

The lower extent 65 of the tubular conduit 29 is internally threaded and matingly engages the external threads of a tubular member 67 which forms a downward continuation of the tubular conduit.

The outer ring element 63 continues downwardly in the form of an actuating sleeve 69 having a piston member 71 formed on the lower end thereof. As can be seen in FIG. 2, the piston member 71 is located in an annular setting chamber 73 formed between the exterior of the tubular member 67 and an outer tubular member 75. The piston member 71 is provided with one or more sets of inner and outer O-ring seals 77, 79 for sealingly engaging the sidewalls of the annular setting chamber. The outer tubular member 75 is also initially shear pinned to the setting sleeve 69 by means of shear pins 81.

The annular shaped gas generating power charge of the invention 83 is located within the annular space defined by the setting chamber 73 below the piston member 71, whereby ignition of the solid propellant power charge 83 moves the piston member 71 axially within the pressure chamber 73 between the running-in position shown in FIG. 2 and a set position.

In addition to the above described components of the actuating section of the device, there is also provided a triggering mechanism for igniting the annular shaped power charge 83. Any suitable triggering mechanism known in the art can be utilized. For instance the sonic frequency generating system shown in U.S. Pat. No. 3,233,674, previously discussed and incorporated herein by reference, could be utilized.

In the embodiment of the invention illustrated in FIGS. 2 and 3, the triggering mechanism includes a Teflon insulated wire 85 passing from the solid propellant charge 83 through a fluid tight coupling 87 to a microprocessor controller 89. A battery source 91 is connected to the microprocessor 89 by connecting wires 93 for supplying direct current to the device.

The microprocessor 89 is capable of being preprogrammed prior to introduction of the apparatus into the well to detect and generate instructions relative to a series of actuating commands. The appropriate instructions cause current to flow from the battery source 91 through wires 93 and 85 to an electric match (igniter) located on the front 84 of the gas generating charge 83 for igniting the solid propellant charge. The specific programming and operation of the microprocessor does not form a part of the present invention and will not be described in greater detail since the triggering mechanism could assume a variety of configurations. For instance, a suitable microprocessor, operated triggering system is described in pending Ser. No. 07/751,861, filed Aug. 28, 1991, entitled "Subsurface Well Apparatus", and assigned to the assignee of the present invention, the disclosure of which is incorporated herein by reference, as well as in its parent application, Ser. No. 549,803 filed Jul. 9, 1990.

As shown in FIG. 3, the various components of the triggering mechanism are located between the outer tubular member 75 and a tubular member 95 which depends downwardly from the tubular member 67 in the string of members making up the tubular conduit 29. The lowermost extent 97 of the outer tubular member 75 has an internally threaded surface which engages a mating externally threaded surface provided on the lowermost extent of the tubular member 95. An O-ring seal 101, together with O-ring seals 103, 105 provided on tubular member 67 and O-ring seals 79 of the piston member 71 prevent fluid communication from the exterior of the device to the annular space 107 containing the triggering mechanism and solid propellant charge.

Figure 4:
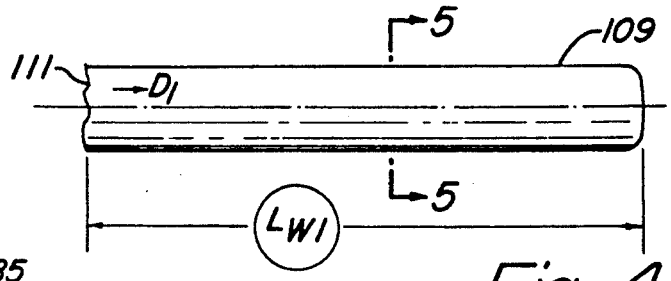
Fig. 4 PRIOR ART
FIG. 4 is a side view of a prior art solid propellant, cylindrical power charge illustrating the web length thereof.
Figure 5:
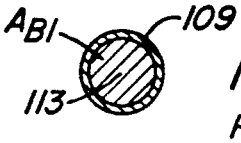
Fig. 5 PRIOR ART
FIG. 5 is a cross-sectional view taken along lines V.—V.

FIG. 4 is a side view of a prior art solid propellant, cylindrical power charge 109. The direction of burn of the charge from the leading end 111 is illustrated by the arrows D1 in FIG. 4 and the web length is illustrated as $L_{w1}$. The burn area for the solid, cylindrically shaped charge is illustrated as 113 in FIG. 5.

The burn area $A_b$ is proportional to the gas generation rate. Thus, the smaller the burn area, the slower the gas generation rate from the charge available for setting the device:

$$A_{b1}L_{w1}=V_p=C$$

The web length $L_{w1}$ determines the total time of burn and the peak pressure ($P_{max}$) the charge will generate since the volume of propellant, $V_p=A_bL_w$.

In order to make a charge which is effective for the slow actuation of downhole tools, the ratio $A_{b1}/L_{w1}$ should be kept as small as possible. In the case of a solid cylindrical charge, this can be accomplished b y providing a relatively long web with a relatively small cross-sectional diameter.

Figure 6:
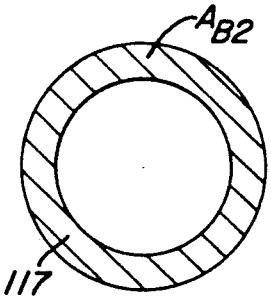
Fig. 6 PRIOR ART
FIG. 6 is an end view of a cylindrical gas generating charge, illustrating the burn area thereof.
Figure 7:
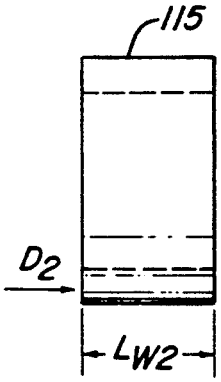
Fig. 7 PRIOR ART
FIG. 7 is a side view of the cylindrically shaped charge of FIG. 6 illustrating the web length thereof.

In the case of a hollow cylindrical charge arrangement, the same concept is more difficult to achieve. Generally, $V_p$ is fixed and, since $A_b$ is large, $L_w$ must be small. FIG. 7 is a side view of a prior art, hollow cylindrical power charge 115. The burn area $A_{b2}$ for the hollow cylindrical power charge 115 is shown in the end view in FIG. 6 as 117. The web length is illustrated as $L_{w2}$ and the direction of burn as D2 in FIG. 7. In this case:

$$A_{b2}L_{w2}=V_p=C.$$

Since $A_{b2}/L_{w2}$ is much greater than $A_{b1}/L_{w1}$, very fast gas generation occurs.

Figure 8:
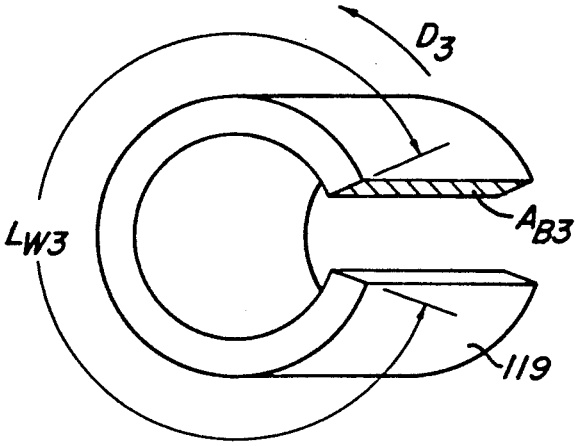
FIG. 8 illustrates a partial cylindrical shape for a gas generating charge showing the burn area and web length thereof.

FIG. 8 shows a C-shaped charge cylinder 119 in which the gas generation rate is slower than in the cylindrically shaped charge 115. The direction of burn is $D_3$, the web length $L_{w3}$ and the burn area $A_{b3}$. In this case, $A_{b3}/L_{w3}$ is greater than $A_{b1}/L_{w1}$. Although the gas generation rate is slower than in the cylindrical charge 115, it is still faster than in the solid cylindrically shaped charge 109.

FIGS. 9–12 illustrate the annular shaped, gas generating power charge of the invention 121. The charge 121 is comprised of a longitudinal strip 123 having a length $L_{w4}$ a width W, a leading end 125 which defines a burn area $A_{b4}$, a trailing end 127 and opposing, non-combustible side edges 129, 131. Although the gas generating power charge 121 is shown having a generally rectangular cross-section in FIGS. 9–12, it will be understood that it could also be of a circular cross-section.

The particular solid propellant selected for use in the longitudinal strip 123 can be obtained from a number of sources. A number of suitable combustible chemical compositions combined with an oxidizer that are substantially self-contained are available which can be energized by an electrical initiating or actuating means, such as the electric match (or igniter) connected to wire 85, previously mentioned. The charge could also be actuated by other means, however, such as by a burning cartridge adapted to be lit when electric current is applied through the wire 85. The solid propellant will preferably contain its own source of oxygen, and will gradually burn away to generate the required gases under pressure for operating the packer. Preferably, the maximum pressure will be generated over a substantial period. It will be understood that burn rate velocity is dependent, to a great extent, upon pressure. Thus, at atmospheric pressure, the total burn time might be as slow as 60 minutes while at 10,000 psi the total burn time might be on the order of 30 seconds. Such slow burning is preferred since a sudden release of energy might damage the packer components, or diminish the sealability of the elastomeric seal element.

Figure 9:
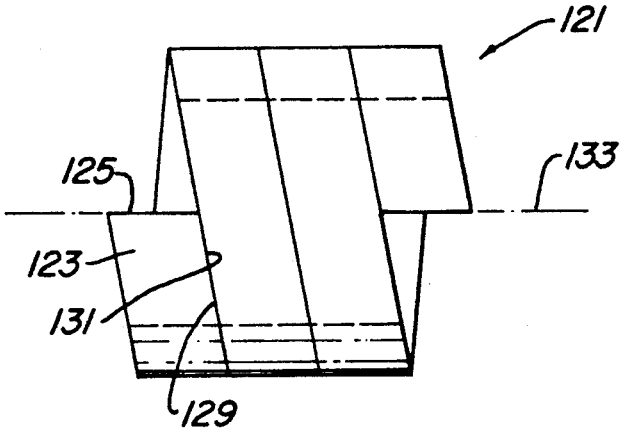
FIG. 9 is a side, plan view of the annular shaped gas generating power charge of the invention.

As shown in FIG. 9, the strip 123 is helically wrapped in at least one spiral turn about a central axis 133, whereby opposing edges 129, 131 of the strip 123 abut one another to form a cylindrical shape. By "helical" is meant a line so curved around a right circular cylinder that it would become a straight line if the cylinder were unfolded into a plane, as illustrated in FIG. 9. That is, a spiral curve occurring in a single plane. Although only one strip 123 is illustrated in the drawings, it will also be understood that a plurality of rectangular or circular cross-sectional strips could be arranged in parallel fashion and burned simultaneously.

It is necessary that the opposing edges 129, 131 of the helically wrapped charge be non-combustible in order that the charge burn evenly from the leading end 125 to the trailing end 127, without bleeding between spiral turns and uncontrolled ignition. This is accomplished by enclosing the propellant within a non-burning wrapping or by applying a suitable burn inhibitor to the strip of propellant. The inhibitor could be applied, e.g., by spraying, painting, dipping, potting, casting, extruding or layering a film or layer of predetermined thickness onto the propellant strip. Specific inhibitor compositions are known in the art and are described, for example, in U.S. Pat. No. 3,496,870, issued Feb. 24, 1970, the disclosure of form a part of the present invention.

Figure 10:
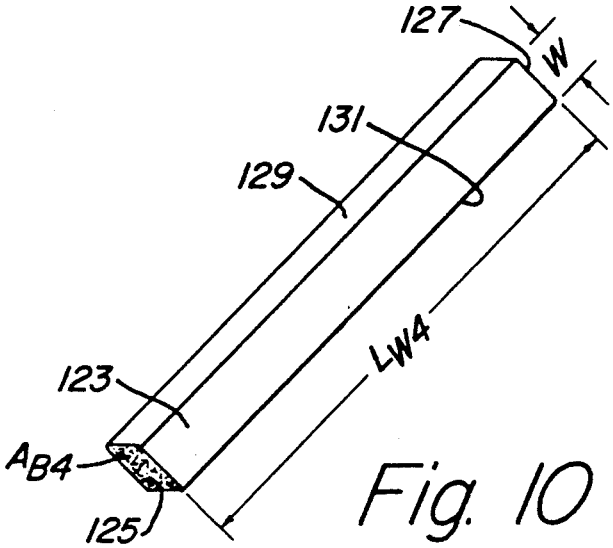
FIG. 10 is a view of the solid propellant power charge of FIG. 9 unwrapped into a straight strip.
Figure 11:
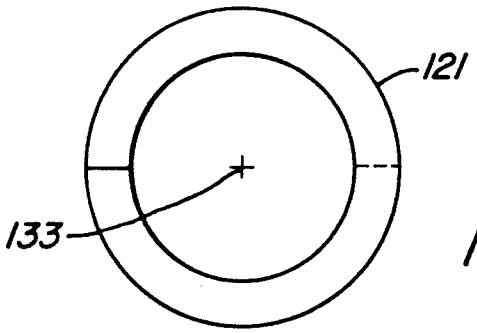
FIG. 11 is an end view of the gas generating charge of FIG. 9.
Figure 12:
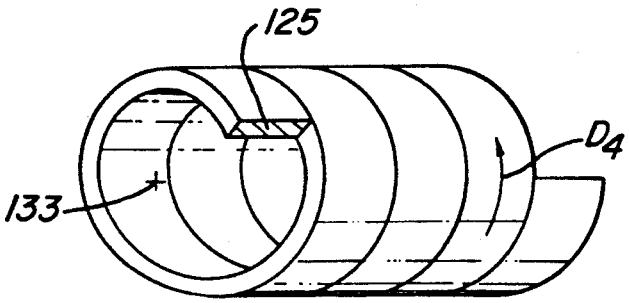
FIG. 12 is a perspective view of the gas generating charge of the invention illustrating the burn area and web length thereof.

In the annular shaped helically wrapped charge of FIGS. 9–11:

$$A_{b4}L_{w4}=V_p=C.$$

In this case, the ratio of $A_{b4}/L_{w4}$ is less than $A_{b1}/L_{w1}$. As a result, the charge shown in FIGS. 9–12 will have the desired slow total gas generation rate needed for the present application. The charge of the invention would generate gas slower than the solid, cylindrically shaped charge 109 shown in FIGS. 4 and 5.

An invention has been provided with several advantages. The helically wrapped, annular shaped charge of the invention has the optimum geometry for slowing down the gas generation rate of a constant volume propellant. Although chemical methods can be employed to slow the gas generation rate of a propellant, they are generally more complex and expensive. The present device is capable of achieving and sustaining a slow rate of gas generation, especially at low ignition temperatures and pressures. The annular shaped gas generating charge of the invention can be employed in a downhole tool, such as a packer, to expand the packing elements at a slow, controlled rate, thereby allowing the elements to be compressed to assume the most desirable packed-off geometry.

While the invention has been shown in only one of its forms, it is not thus limited but is susceptible to various changes and modifications without departing from the spirit thereof.

I claim:

1. An annular shaped gas generating power charge of the type adapted to be used in a downhole tool in a subterranean well, the power charge comprising:

a longitudinal strip of propellant having a length and a width less than the length, a leading end which defines a burn area, a trailing end and opposing non-combustible side edges, the strip being helically wrapped in a plurality of spiral turns occurring in a single plane about a central axis, whereby opposing edges of the strip abut one another to form a right circular cylinder.

2. In a downhole tool of the type used in a subterranean well having a tubular conduit of a given length extending downwardly from the well surface into contact with well fluids, at least a portion of the length of the tubular conduit being surrounded by an outer tubular member, the improvement comprising:

an annular shaped gas generating power charge located in an annular space created between the tubular conduit and the outer tubular member, the power charge being comprised of a longitudinal strip of propellant having a length and a width less than the length, a leading end which defines a burn area, a trailing end, and opposing non-combustible side edges, the strip being helically wrapped about the tubular conduit in a plurality of spiral turns about a central axis, whereby opposing edges of the strip abut one another to form a cylindrical shape between the tubular conduit and the outer tubular member; and setting means responsive to ignition of the power charge for moving the downhole tool from a first position to a second position.

3. The downhole tool of claim 2, wherein the setting means includes a piston member slidably and sealably mounted in an annular chamber on the exterior of the tubular conduit, the piston member having a piston area exposed to the annular space containing the annular shaped gas generating charge, wherein ignition of the power charge moves the piston axially within the annular chamber.

4. The downhole tool of claim 3, wherein the tubular conduit extending downwardly from the well surface into contact with well fluids is imperforate between the well surface and the annular chamber containing the piston member.

5. A downhole tool adapted for use in a subterranean well having an imperforate tubular conduit extending from the well surface downwardly to an actuating section, the downhole tool comprising:

an inner tubular member having an imperforate length and being adapted to be made up in the imperforate tubular conduit extending from the well surface;

an outer tubular member surrounding at least a portion of the inner tubular member and spaced-apart therefrom to define an annular space within the well tool;

an annular shaped gas generating power charge located in the annular space, the power charge being comprised of a longitudinal strip of propellant having a length and a width less than the length, a leading end which defines a burn area, a trailing end, and opposing non-combustible side edges, the strip being helically wrapped about the inner tubular member in a plurality of spiral turns about a central axis, whereby opposing edges of the strip abut one another to form a cylindrical shape within the annular space;

packing means surrounding a portion of the imperforate tubular conduit for forming a seal with the surrounding well bore; and setting means responsive to ignition of the power charge for moving the packing means into sealing engagement with the surrounding well bore.

6. The downhole tool of claim 5, further comprising:

a piston slidably and sealably mounted in an annular chamber on the exterior of the tubular conduit, the piston member having a piston area exposed to the annular space containing the annular shaped gas generating charge, wherein ignition of the power charge moves the piston axially within the annular chamber, the piston member being operatively connected to the packing means for setting the packing means by axial movement of the piston.

7. The downhole tool of claim 6, wherein the annular shaped gas generating power charge is helically wrapped in a plurality of spiral turns, the plurality of turns forming a spiral curve in a single plane which defines a right circular cylinder.

* * * * *